United States Patent [19]

Wong

[11] Patent Number: 4,818,964

[45] Date of Patent: Apr. 4, 1989

[54] SWITCHABLE MULTI-POWER-LEVEL SHORT SLOT WAVEGUIDE HYBRID COUPLER

[75] Inventor: Mon N. Wong, Torrance, Calif.

[73] Assignee: Hughes Aircraft Company, Los Angeles, Calif.

[21] Appl. No.: 856,089

[22] Filed: Apr. 28, 1986

[51] Int. Cl.[4] ..... H01P 5/18

[52] U.S. Cl. ..... 333/111; 333/113

[58] Field of Search ..... 333/111, 113

[56] References Cited

U.S. PATENT DOCUMENTS

| | | | |
|---|---|---|---|
| 2,820,201 | 1/1958 | Tomiyasu . | |
| 2,955,268 | 10/1960 | Riblet . | |
| 3,017,585 | 1/1962 | Luke | 333/113 X |
| 3,044,026 | 7/1962 | Patterson | 333/113 |
| 3,098,983 | 7/1963 | Oliner | 333/113 |
| 4,035,598 | 7/1977 | Van Amsterdam . | |
| 4,127,829 | 11/1978 | Levy et al. . | |
| 4,216,409 | 8/1980 | Sato et al. . | |
| 4,679,011 | 7/1987 | Praba et al. | 333/111 |
| 4,691,177 | 9/1987 | Wong et al. | 333/113 |

FOREIGN PATENT DOCUMENTS

| | | | |
|---|---|---|---|
| 1152601 | 2/1958 | France | 333/113 |
| 94505 | 5/1985 | Japan | 333/113 |
| 2024526 | 1/1980 | United Kingdom . | |

OTHER PUBLICATIONS

Riblet, *The Short-Slot Hybrid Junction,* Proc. of IRE, vol. 40, No. 2, Feb. 1952, p. 182 relied on.

*Primary Examiner*—Paul Gensler

*Attorney, Agent, or Firm*—S. M. Mitchell; M. J. Meltzer; A. W. Karambelas

[57] ABSTRACT

A short slot waveguide hybrid coupler is disclosed wherein the coupling factor is switchable over a predetermined range of discrete coupling factors. A coupling slot formed in the common dividing wall between the contiguous first and second waveguides of the coupler allows coupling of electromagnetic energy between the two waveguides in accordance with a first coupling factor. A plurality of conductive pins are arranged for selective insertion into the coupling slot to effectively shorten the slot and thereby progressively reduce the coupling factor as more pins are inserted into the coupling slot.

10 Claims, 1 Drawing Sheet

SWITCHABLE MULTI-POWER-LEVEL SHORT SLOT WAVEGUIDE HYBRID COUPLER

BACKGROUND OF THE INVENTION

The present invention relates to power dividers for rf energy, and more particularly to an improved multi-power-level waveguide hybrid coupler.

Hybrid couplers are widely used in microwave circuits for coupling a portion of the electromagnetic energy in one waveguide to another waveguide. In some cases, the coupling ratio is one-half so as to produce an equal split of the power among the two waveguides. In other cases, a smaller amount of the power such as one-quarter or one-tenth of the power may be coupled from one waveguide to the second waveguide. In a common form of coupler, known as a hybrid coupler, the two waveguides are brought contiguous to each other and in parallel relationship so as to share a common wall. An aperture in the common wall provides for the coupling of the electromagnetic energy.

In some applications, it is desirable to have the capability to selectively vary the relative rf power split between the first and second waveguides. One such application is in satellite antenna feed networks, wherein the capability of a variable power split could be employed to vary the radiating power distribution. The power distribution of the satellite antenna system could then be varied by execution of commands from a ground station.

Applicant has previously devised a switchable 3 dB waveguide hybrid which can be switched between the equal-power split state and the state wherein effectively no power is coupled to the second waveguide. This is accomplished by dropping three spaced pins into the aperture in the common wall to effectively close the aperture or by raising the pins to open the aperture to allow coupling of energy into the second waveguide in the conventional manner. For many applications, however, this effective on/off capability is insufficient to achieve a desired system flexibility.

It would therefore represent an advance in the art to provide a switchable waveguide hybrid coupler for providing one of several possible power levels on command and which is relatively simple and inexpensive to fabricate.

SUMMARY OF THE INVENTION

A switchable multi-power-level waveguide hybrid coupler is disclosed. In the preferred embodiment, the coupler takes the form of a short slot waveguide hybrid coupler, wherein first and second rectangular waveguides are disposed in a contiguous side-by-side relationship, sharing a sidewall as a common dividing wall. A coupling slot is formed in the common sidewall to provide a means for coupling electromagnetic energy between the first and second waveguides in accordance with a first coupling factor. A plurality of retractable pins are provided in a spaced relationship along the longitudinal extent of the coupling slot. Respective abutments are disposed along each respective short wall of the waveguides to reduce the waveguide width along the slot and thereby enhance higher coupling levels. Respective ridge members are placed along one broadwall of each waveguide to concentrate the electric field in the center of the guides and thereby provide the capability of lower coupling factors. An actuating mechanism is provided to selectively insert or withdraw particular pins from the slot to control the coupling factor of the hybrid coupler.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1:
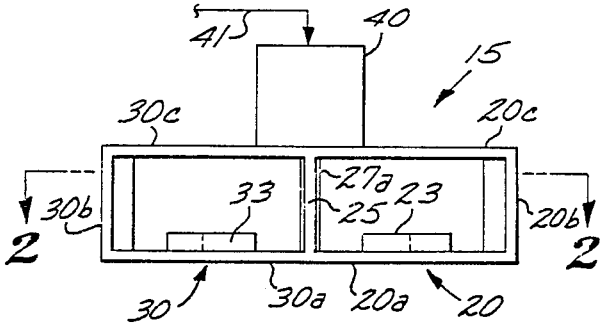
FIG. 1 is an end view of the switchable hybrid coupler embodying the invention.
Figure 2:
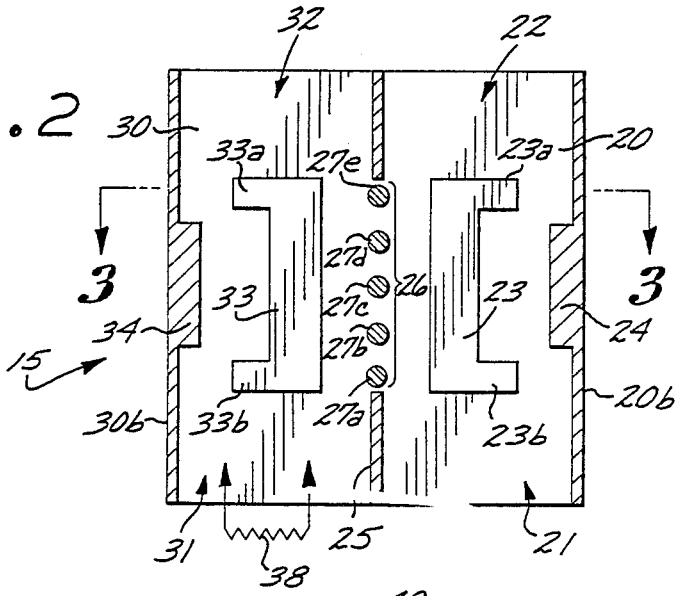
FIG. 2 is a cross-sectional view of the hybrid coupler of FIG. 1, taken along line 2—2 of FIG. 1.
Figure 3:
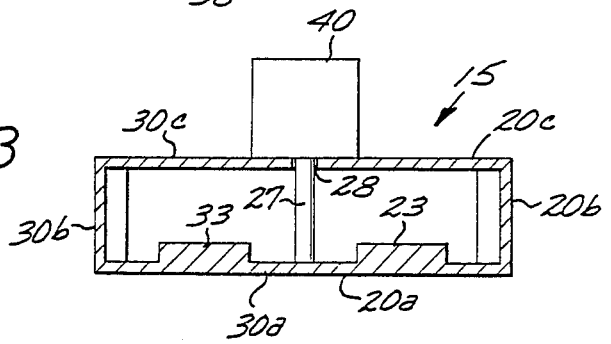
FIG. 3 is a cross-sectional view of the hybrid coupler of FIGS. 1 and 2, taken along line 3—3 of FIG. 2.

As shown in FIGS. 1–3, the preferred embodiment of the coupler 15 comprises a pair of waveguide members 20 and 30 disposed in a side-by-side relationship each having a rectangular cross-section. For operation at microwave frequencies around 12 GHz, waveguide type WR-75 is employed, wherein the respective widths (sidewall-to-sidewall) and lengths (end-to-end) of the waveguides 20 and 30 are 0.750 inches and 2.250 inches. The four ports 21, 31, 22, 32 of the respective through and coupled waveguide members 20 and 30 define the respective input, isolation, through and coupled ports of the hybrid coupler 15. Each of the waveguides has two broadwalls, namely, top walls 20*c* and 30*c* and bottom walls 20*a* and 30*a*. The broadwalls are joined by respective shortwalls, namely, outer sidewalls 20*b* and 30*b* and a common wall 25 which serves as an inner sidewall for each of the two waveguides 20 and 30. It is to be understood that FIGS. 1–4 are not drawn to scale.

Respective elongated ridge sections 23 and 33 are disposed along respective bottom walls 20*a* and 30*a* of the through and coupled waveguide members 20, 30, each having respective sidearm members 23*a*, 23*b* and 33*a*, 33*b* extending toward the opposing sidewall 20*b*, 30*b* of the respective waveguides 20 and 30. In the preferred embodiment, these ridge sections are fabricated from a conductive material such as brass and have a length dimension of about 1.22 inches and a height dimension of about 0.10 inches. The width of the ridge sections through the sidearm regions is about 0.40 inches; the width of the ridge sections through the regions intermediate the sidearms is about 0.25 inches. As is apparent in FIGS. 1 and 2, the ridge members 23 and 33 are generally the same length as the slot 26 and are aligned with the slot. As appears, for example, in the end view of FIG. 1, the ridges are disposed with their rectangular end profiles generally centered between the sidewalls of the respective waveguides.

In the $TE_{10}$ mode, the electric field is concentrated in the middle section of the waveguide between the opposing center wall and sidewall. The ridges 23 and 33 function to concentrate the electric field even more in the middle section of the respective waveguides 20 and 30. This reduces the amount of energy which is coupled through the slot 26 into the coupled waveguide 30.

Respective abutments 24 and 34 are disposed along the respective opposite sidewalls 20*b* and 30*b* of the through and coupled waveguide members 20 and 30 on a center line of the coupling slot 26 formed in the common dividing wall 25. The abutments 24, 34 are formed of a conductive material, such as brass, and reduce the width of the waveguides 20, 30 at the coupling slot, forming regions of reduced width within the waveguides. These abutments and the ridges 23 and 33 serve as impedance matching elements, and minimize the slope of the output power versus frequency function of the coupler 15. The characteristic impedance is relatively constant over the frequency band of interest due to the inductive reduced-width regions, complimented by the capacitive ridges 23, 33.

The isolation port 31 of the coupler 15 is shown connected schematically to a resistor 38 which represents a nonreflecting load having an impedance matched to the characteristic impedance of the waveguide 30. Such a load (not shown) is constructed typically in the form of a well-known wedge which absorbs electromagnetic energy at the operating frequency of the coupler 15, and is conveniently mounted within a section of waveguide (not shown) connected to the isolation port 31 by flanges (not shown). In use, as will be appreciated by those skilled in the art, the coupler would be connected to components of a microwave circuit (not shown); such components may include waveguide fittings which would be connected in a conventional manner, as by flanges (not shown) to the respective ports 21, 22, 32 of the coupler 15.

As described above, a coupling aperture or slot 26 is formed in the common wall 25. In the disclosed embodiment, the longitudinal extent of the slot 26 is about seven tenths of the waveguide wavelength, $\lambda_g$, of interest, about 1.3 inches. Electromagnetic energy applied at the input port 21 will be propagated in the $TE_{10}$ mode along the waveguide 20 toward the output port 22. The region of reduced width defined by the abutment 24 and common wall 25 tends to urge the electric field of the incident energy toward the ridge 23. An electric charge built up between the ridge 23 and its opposite sidewall **20*b* reduces the transverse current flowing through the slot 26 in the dividing wall 25. Therefore, most of the input energy will be guided along the ridge 23 and arrive at the through port 22**. In the disclosed embodiment, the ratio of coupled power at the coupled port to the through power at the through port is about −5 dB.

The selective coupling of the coupler 15 is accomplished by controlling the amount of transverse current flow through the slot 26 to excite a complimentary $TE_{10}$ mode in the coupled waveguide 30. Retractable pins **27*a–e* are provided for extension into the slot 26 in alignment with the dividing wall 25 and with the electric field of the $TE_{10}$ mode energy. The pins are arranged to extend through bores 28 formed in the adjacent upper walls 20*c*, 30*c* of the waveguides 20,30 and extend downwardly to the bottom walls 20*a*, 30*a* of the waveguides 20,30. The pin spacing is equidistant, with the pin centers separated by about one tenth of the waveguide wavelength; in the disclosed embodiment the center-to-center spacing is about 0.20 inches. The end pins 27*a* and 27*e* are respectively spaced from the ends of the wall 25 defining the slot 26 by a distance less than one tenth of the waveguide wavelength. In the extended position, the pin extends from the upper walls 20*c* and 30*c* to the lower walls 20*a* and 30*a* (FIG. 3**).

Figure 4:
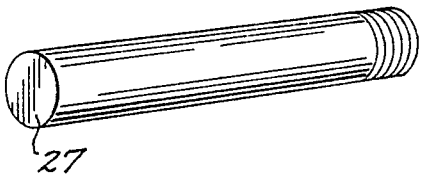
FIG. 4 is a perspective view of an exemplary pin such as is employed in the hybrid coupler of FIGS. 1–3.

A representative pin 27 is shown in FIG. 4. One end of the pin is threaded for attachment to the pin actuator mechanism. In the disclosed embodiment, the diameter of the respective bores 28 is 0.069 inches, and the diameter of the respective pins is 0.063 inches. The pins are fabricated from a conductive material, such as brass. The thickness of the common wall 25 is about 0.030 inches.

An actuating mechanism is provided to selectively withdraw particular ones of the pins **27*a–e* from the slot 26 to control the coupling ratio of the hybrid coupler 15. With all five pins retracted so that the slot 26 is completely unobstructed, the coupling factor is about −5 dB. When only pin 27*a* is inserted through the slot 26, the longitudinal extent of the slot 26 is effectively reduced by about 0.063 inches. Consequently, the coupling shunt reactance is also reduced, and as a result, the transverse surface current flowing through the slot into the reduced width region of the coupled waveguide section will be reduced. Hence, less microwave energy will be coupled into the coupled waveguide 30**.

With five pins **27*a–e* which may be independently retracted or inserted, there are sixteen possible combinations of control pin position configurations, thereby providing a number of different possible coupling factors. When all of the pins are inserted through the slot 26**, there will be effectively no energy coupling, since the pins are spaced at one tenth of the waveguide wavelength.

The reconfigurable coupler 15 has the same phase characteristic as the conventional quadrature sidewall short slot coupler. The signal arriving at the through port 22 leads the signal arriving at the coupled port 32 by 90°, this phase shift being inherent in the well-known operation of a quadrature sidewall short slot hybrid coupler with a minimal signal at the isolated port.

To actuate the pins, solenoid actuators or stepping motors may be employed in a suitable mechanism to drive the respective pins between the retracted and inserted positions. The mechanism may be located adjacent the top surfaces of the top walls 20C and 30C of the waveguides, and is generally depicted by reference numeral 40 in FIGS. 1 and 3. The actuator mechanism is adapted to independently actuate each of the five pins **27*a–e* upon appropriate control signals provided on control line 41. The pins 27*a–e* may secured to the actuating mechanism 40 by suitable fastening means, such as by engagement of threads formed at one end of the pins (FIG. 4**) into threaded bores formed in the actuating mechanism. Various mechanisms suitable for the purpose in particular applications may be readily devised by those skilled in the art.

The disclosed embodiment has been tested for four power levels over the frequency band from 11.7 GHz to 12.2 GHz. The results set forth in Table I were obtained.

TABLE I

| PIN INSERTION | COUPLING | RETURN LOSS | ISO-LATION | SLOPE |
|---|---|---|---|---|
| 27a | −7.08 dB | −23.47 dB | −21.7 dB | .10 dB |
| 27b | −8.54 dB | −18.78 dB | −26.2 dB | .12 dB |
| 27b and 27d | −14.28 dB | −20.89 dB | −38.2 dB | .26 dB |
| 27a–e | −28.58 dB | −18.43 dB | −41.3 dB | 1.93 dB |

It is understood that the above-described embodiment is merely illustrative of the possible specific embodiments which may represent principles of the present invention. Other arrangements may be devised in accordance with these principles by those skilled in the art without departing from the scope of the invention.

What is claimed is:

1. A switchable hybrid coupler adapted for selective control of the hybrid coupling ratio, comprising:

a first waveguide and a second waveguide disposed in a contiguous side-by-side relationship each including a pair of broadwalls and a pair of sidewalls and sharing one of said sidewalls as a common dividing sidewall;

a coupling slot formed in said common sidewall to couple electromagnetic energy between said first and second waveguides;

a plurality of conductive pins arranged to be inserted between said broadwalls of said waveguides along said slot; and means for independently actuating each of said pins between an inserted position and a retracted position wherein each respective pin is retracted through an opening in one of said broadwalls;

whereby the coupling ratio of the hybrid coupler is selected by the particular selected combination of said pins which are in the inserted position.

2. The switchable hybrid coupler of claim 1 and further including means for concentrating the electric field of the electromagnetic energy in a region of said waveguides spaced from said coupling slot to limit the amount of energy coupled between said waveguides.

3. The switchable hybrid coupler of claim 2 wherein said conductive pins are arranged to be inserted into said coupling slot in substantial alignment with the electric field of the electromagnetic energy in the coupler.

4. The switchable hybrid coupler of claim 2 further comprising impedance matching means for maintaining a relatively constant coupler characteristic impedance over a frequency band of interest.

5. The switchable hybrid coupler of claim 4 wherein said impedance matching means comprises said concentrating means and means for reducing the cross-section of said waveguides at said coupling slot.

6. The switchable hybrid coupler of claim 5 wherein said reducing means comprises first and second conductive abutments extending into the respective first and second waveguides from said waveguide sidewalls opposite said coupling slot.

7. The switchable hybrid coupler of claim 5 wherein said means for concentrating the electric field provides a capacitive impedance component and said reducing means provides an inductive impedance component, whereby the cooperative effect of said concentrating means and said reducing means maintains said relatively constant characteristic impedance.

8. A waveguide hybrid coupler adapted for selective control of the hybrid coupling ratio, comprising:

a first waveguide and a second waveguide disposed in a contiguous side-by-side relationship and separated by a common dividing sidewall, and wherein each of said waveguides comprises metallic walls assembled with a rectangular cross-section comprising respective broadwalls and sidewalls;

a coupling slot formed in said common sidewall to couple electromagnetic energy between said first and second waveguides;

a plurality of conductive pins arranged to be inserted between said broadwalls of said waveguides along said slot to selectively reduce the coupling shunt reactance of said slot;

means for independently actuating each of said pins between an inserted position and a retracted position wherein said respective pin is retracted through an opening in one of said broad walls; and means for concentrating the electric field of the electromagnetic energy in a region of the waveguides spaced from said coupling slot to limit the amount of energy coupled between said waveguides, whereby the coupling ratio of the hybrid coupler is selected by the particular selected combination of said pins which are in the inserted position.

9. The hybrid coupler of claim 8 wherein said coupling ratio selected by the particular combination of inserted pins is in the range of about −5 dB to about −28 dB.

10. A switchable multi-power-level short slot waveguide hybrid coupler for coupling a selectively variable portion of the electromagnetic energy in one waveguide to a second waveguide, comprising:

a first waveguide and a second waveguide arranged in a contiguous side-by-side relationship each including a pair of broadwalls and a pair of sidewalls and sharing one of said sidewalls as a common dividing wall;

means for variable coupling electromagnetic energy between said first and second waveguides, said means including a coupling slot formed in said common wall and control means adapted to select the coupling ratio of the coupled energy to the incident energy by selectively obstructing regions of said coupling slot;

first and second conductive raised ridge members respectively disposed along a broadwall of said first and second waveguides opposite said slot for concentrating the electric field of the electromagnetic energy in a region of the waveguides spaced from said coupling slot to limit the amount of energy coupled between said waveguides and provide coupling ratios of less than equal power division; and each of said ridge members comprising an elongated central ridge section joining first and second sidearm sections, each of said sidearm sections extending toward a respective waveguide sidewall opposing said coupling slot.

* * * * *